United States Patent [19]

Norfleet

[11] Patent Number: 4,484,768

[45] Date of Patent: Nov. 27, 1984

[54] GREETING CARD

[76] Inventor: Lincoln H. Norfleet, 3461 Meier St., Memphis, Tenn. 38118

[21] Appl. No.: 537,503

[22] Filed: Sep. 30, 1983

[51] Int. Cl.[3] ..... B42D 15/02

[52] U.S. Cl. ..... 283/1 B; 40/124.1; 40/407; 446/147; 206/634; 239/56; 239/289; 428/101; 428/121; 428/309.9; 428/313.3; 428/314.4; 428/317.1; 428/321.1; 428/905

[58] Field of Search ..... 222/541; 206/469, 470, 206/476, 620, 627, 634; 283/1 B, 56, 92, 94, 95, 98, 101, 106; 229/92.8; 239/5, 6, 53, 54, 55, 56, 289; 46/35, 174; 369/68, 273; 428/101, 121, 309.9, 313.3, 314.4, 317.1, 320.2, 321.1, 905, 542.6; 40/124.1, 158 R, 407

[56] References Cited

U.S. PATENT DOCUMENTS

| | | | |
|---|---|---|---|
| 2,717,174 | 8/1951 | Casanovas | 428/905 |
| 3,116,077 | 9/1967 | Bird | 283/56 |
| 3,570,139 | 8/1969 | Ladd et al. | 428/905 |
| 4,145,001 | 3/1979 | Weyenberg et al. | 428/43 |
| 4,277,024 | 7/1981 | Spector | 428/905 |
| 4,296,179 | 10/1981 | Wardwell | 428/43 |

*Primary Examiner*—George F. Lesmes
*Assistant Examiner*—William M. Atkinson
*Attorney, Agent, or Firm*—Walker & McKenzie

[57] ABSTRACT

A greeting card that produces an odor when opened. The card includes a first plate, a second plate normally covered by the first plate, an odor producing substance and a frangible odor-proof container for containing the odor producing substance. The container is coupled to the first plate in such a manner that it will be broken when the first plate is moved to view the second plate.

1 Claim, 6 Drawing Figures

GREETING CARD

BACKGROUND OF THE INVENTION

1. Field of the Invention

The present invention relates to greeting cards and the like and more particularly comprises a novel greeting card that emits an odor when opened.

2. Description of the Prior Art

Heretofore, various novel greeting cards and the like have been developed. See, for example, Barker, U.S. Pat. No. 2,906,058; Mateo, U.S. Pat. No. 3,307,281; and Stonoga, U.S. Pat. No. 4,203,516. Additionally, various means have been developed for allowing controlled release of a fragrance or the like. See, for example, Weyenberg, U.S. Pat. No. 4,145,001 and Armstrong, U.S. Pat. No. 4,345,716. None of the above patents disclosure or suggest the present invention.

SUMMARY OF THE INVENTION

The present invention is directed toward providing an improved greeting card. The concept of the present invention is to provide a greeting card which emits a fragrance or odor when opened.

The improved greeting card of the present invention is of the type that includes a first plate or panel on which an opening message is typically located, and a second plate or panel on which a further message is typically located, the first plate normally covering the further message on the second plate whereby the first plate has to be moved in order to view the further message on the second plate. The improvement of the present invention comprises, in general, an odor means for emitting a specific odor; a frangible container means for containing the odor means, the container means being odor-proof for preventing the odor means from emitting an odor when contained by the container means; and coupling means for coupling the container means to the first plate in such a manner that the container means will be broken when the first plate is moved in order to view the further message on the second plate.

DESCRIPTION OF THE PREFERRED EMBODIMENT

Figure 1:
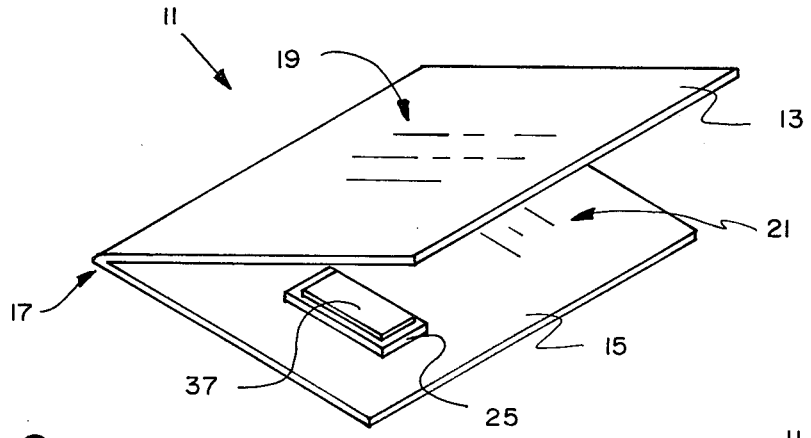
FIG. 1 is a perspective view of the improved greeting card of the present invention.

The improved greeting card 11 of the present invention is of the type including at least a first plate or panel 13 and a second plate or panel 15 with the first plate 13 normally covering a portion of the second plate 15 whereby the first plate 13 will have to be moved in order to completely view the second plate 15. Thus, the greeting card 11 may be of the typical one-fold type wherein the first and second plates 13, 15 are formed by folding a single piece of card-type paper or the like along a single fold line 17. An opening message 19 is typically located on the first plate 13 and a closing or further message 21 is typically located on the second plate 15.

The improvement of the present invention comprises, in general, an odor means 23 for emitting an odor; a frangible container means 25 for containing the odor means 23, and a coupling means for coupling the container means 25 to the first plate 13 in such a manner that the container means 25 will be broken when the first plate 13 is moved in order to view the further message 21 on the second plate 15.

Figure 3:
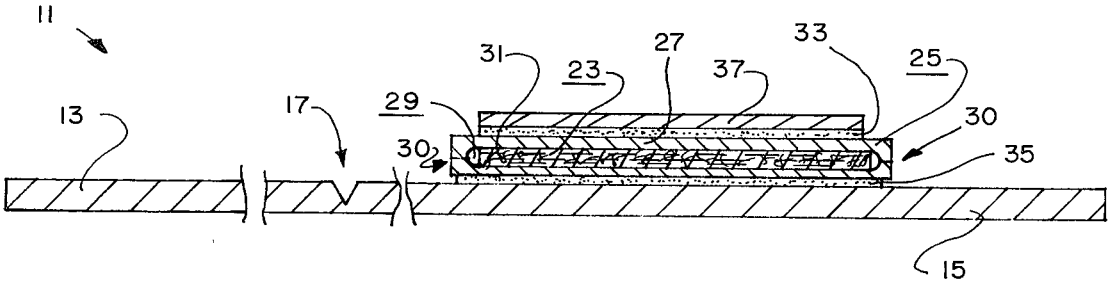
FIG. 3 is an enlarged sectional view thereof substantially as taken on line III—III of FIG. 2.

The container means 25 may consist simply of a bag or pouch member 27 having a hollow interior 29 for containing the odor means 23. The pouch member 27 is constructed of an odor-proof material for preventing the odor means 23 from emitting an odor when contained by the container means 25. Thus, for example, the pouch member 27 may be constructed of two squares of aluminum foil glued or otherwise attached to one another at the edges thereof to form an odor-proof pouch. The pouch member 27 may have a weakened area to allow it to be easily broken or pulled apart. Thus, for example, the joint 30 (see FIG. 3) where the two squares of aluminum foil are glued together may be weaker than the foil itself so that the joint 30 will fail when the pouch member 27 is coupled to the first plate 13 in a manner hereinafter to be described, and the first plate 13 is moved away from the second plate 15.

The odor means 23 may consist of any substance known to those skilled in the art. For example, the odor means 23 may consist of a volatile liquid such as a typical liquid perfume or the like. The liquid may be contained within an absorbent member 31 such as a cotton pad or the like. It should be noted that the odor means 23 consist of various means for producing various specific odors. The specific odor or fragrance produced by the odor means 23 is preferably associated with the message or greeting set forth by the card 11. Thus, for example, if the message set forth by the card 11 is an insult or the like, the specific odor produced by the odor means 23 may be an unpleasant or fetid one.

The coupling means preferably includes a first adhesive member 33 for fixedly attaching the container means 25 to the first plate 13 and preferably includes a second adhesive member 35 for fixedly attaching the container means 25 to the second plate 15. The first and second adhesive members 33, 35 may be of any specific construction apparent to those skilled in the art. For example, the first and second adhesive means 33, 35 may consist simply of typical double-sided tape having a first side for being fixedly attached to the container means 25 and having a second side for being fixedly attached to the respective first or second plate 13, 15. The coupling means preferably includes a removable cover memeber 37 for temmporarily covering one of the adhesive members 33, 35 (see FIG. 3) to allow the second plate 15 to be personalized (e.g., signed) before the container means 25 is fixedly attached to both first and second plates 13, 15. The cover member 37 may consist simply of paper or the like for being positioned over one of the adhesive members 33, 35 whereby the card 11 can be opened and signed or the like before it is "activated".

The use and operation of the improved greeting card 11 is relatively simple. The purchaser of the card 11 merely selects a card containing the desired message.

Figure 2:
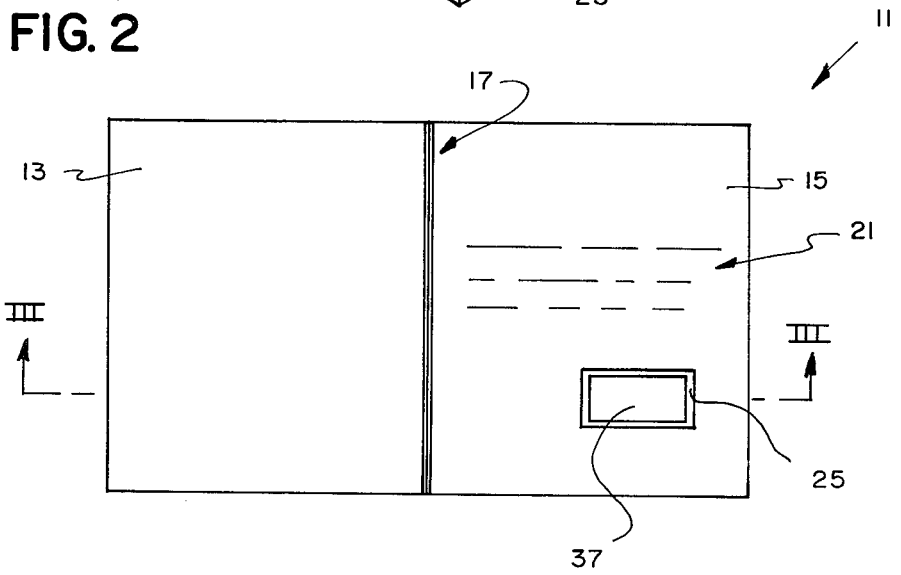
FIG. 2 is a plan view thereof with the greeting card in an opened position.
Figure 4:
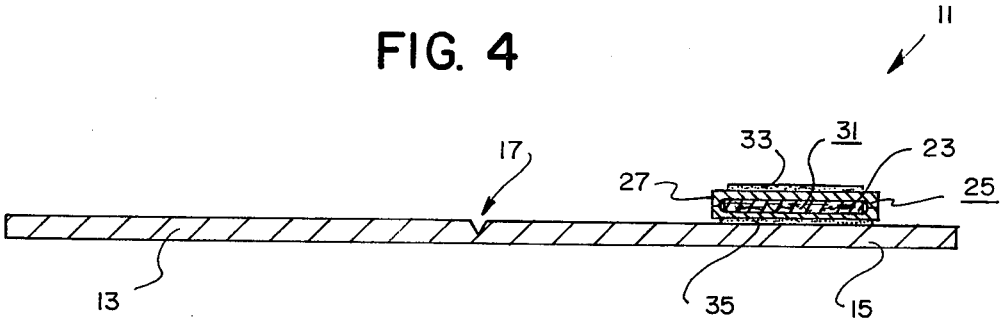
FIG. 4 is a sectional view similar to FIG. 3 but with a cover member of the coupling means removed to allow the greeting card to be "activated".
Figure 5:
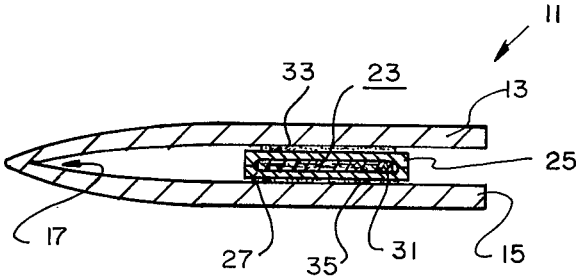
FIG. 5 is a sectional view substantially similar to FIG. 4. but with the greeting card in a closed, activated position.
Figure 6:
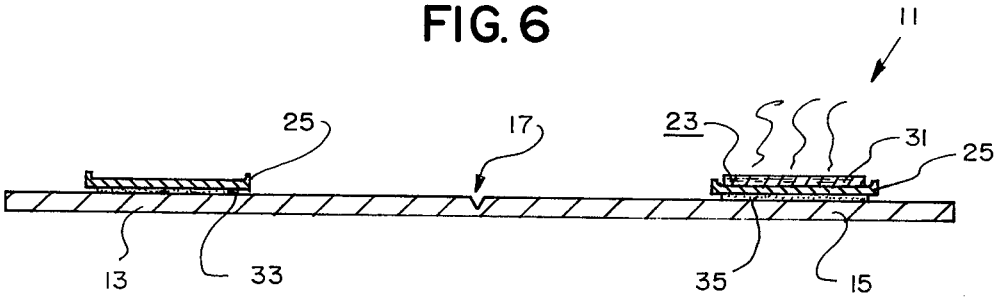
FIG. 6 is a sectional view similar to FIG. 4 but with the container means broken so as to emit an odor.

When first obtained, the greeting card 11 will be in a "deactivated" position, with the cover member 37 covering one of the adhesive members 33, 35. Thus, the card 11 is shown in the deactivated position in FIGS. 1, 2 and 3 with the cover member 37 covering the first adhesive member 33 whereby the container means 25 is fixedly attached to the second plate 15 but is not attached to the first plate 13. The purchaser of the card can then personalize the card 11 in any typical manner such as by signing the second plate 15. The cover member 37 can then be removed and the first plate 13 placed over the second plate 15 in the normal manner whereby the first adhesive member 33 will fixedly attach the container means 25 to the first plate 13 (see FIGS. 4 and 5). Thus, the card 11 is shown in the "activated" position in FIG. 5. The card 11 can then be delivered to the desired recipient who typically reads the opening message 19 on the first plate 13 and then moves the first plate 13 so as to view the further message 21 on the second plate 15. When the first plate 13 is so moved, the container means 25 will break or tear apart as indicated in FIG. 6, thus allowing the odor means 23 to emit an odor as the further message 21 is read.

Although the invention has been described and illustrated with respect to a preferred embodiment thereof and a preferred use therefor, it is not to be so limited since changes and modifications can be made therein which are within the full intended scope of the invention.

I claim:

1. An improved greeting card of the type including a first plate on which an opening message is located and including a second plate on which a further message is located, said first plate normally covering said further message on said second plate whereby said first plate has to be moved in order to view said further message on said second plate, wherein the improvement comprises:

(a) an odor means for emitting an odor, said odor means comprising an absorbant member containing a volatile odor-emitting fluid, (b) a frangible container means for containing said odor means, said container means being odor-proof for preventing said odor means from emitting an odor when contained by said container means, (c) a coupling means for coupling said container means to said first and second plates such that said container means will be broken when said first plate is moved in order to view said further message or said second plate, and for causing an odor to be emitted as said further message is viewed, said coupling means includes a first adhesive member for fixedly attaching said container means to said first plate, a second adhesive member for fixedly attaching said container means to said second plate and a removable cover member for temporarily covering one of said adhesive members to allow said second plate to be personalized before said container means is fixedly attached to both said first and second plates.

* * * * *